US007632140B2

(12) United States Patent
Ting

(10) Patent No.: US 7,632,140 B2
(45) Date of Patent: Dec. 15, 2009

(54) CARD CONNECTOR

(75) Inventor: Chien-Jen Ting, Tu-cheng (TW)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/156,026

(22) Filed: May 28, 2008

(65) Prior Publication Data

US 2008/0299807 A1 Dec. 4, 2008

(30) Foreign Application Priority Data

May 28, 2007 (TW) ..... 96118913 A

(51) Int. Cl.
*H01R 13/60* (2006.01)

(52) U.S. Cl. ..... 439/541.5; 439/159

(58) Field of Classification Search ..... 439/541.5, 439/159, 160, 631

See application file for complete search history.

(56) References Cited

U.S. PATENT DOCUMENTS

2006/0128189 A1* 6/2006 Kuo et al. ..... 439/157

* cited by examiner

*Primary Examiner*—Ross N Gushi
(74) *Attorney, Agent, or Firm*—Andrew C. Cheng; Wei Te Chung; Ming Chieh Chang

(57) ABSTRACT

A card connector (100) includes an insulating housing (2) comprising a base section (20) and a fixing portion (22) extending laterally from the base section, an ejecting mechanism (6, 7) mounted in the fixing portion, a plurality of first terminals (3) received in the base section for electrically engaging with a first card, a terminal module (45) located under the insulating housing and receiving a plurality of second terminals (6) for electrically engaging with a second card, and a socket device (9) comprising a spacer (91) mounted on a rear end of the insulating housing, a daughter board (92) in alignment with the spacer and having a plurality of connecting pins (921), and a rear socket (93) connecting with the connecting pins. Wherein the first terminals and the second terminals pass through corresponding terminal holes (912, 913) defined on the spacer, and engage with corresponding conductive portions (923, 924) formed on the daughter board.

16 Claims, 5 Drawing Sheets

CARD CONNECTOR

BACKGROUND OF THE INVENTION

1. Field of the Invention

The present invention relates to a card connector, and particularly to a card connector for receiving two cards.

2. Description of Prior Arts

Memory cards are known in the art and contain intelligence in the form of a memory circuit or other electronic program. Some form of card reader reads the information or memory stored on the card. Memory cards are used in many applications in today's electronic society, including video cameras, smart-phones, music players, ATMs, cable television decoders, toys, games, PC adapters and other electronic applications. A typical memory card includes a contact or terminal array for connection through an electrical connector to a card reader system and then to external equipment. The connector readily accommodates insertion and removal of the card to provide quick access to the information and program on the card. The card connector includes terminals for engaging with the contact or terminal array of the card. Additionally, the connector always has an ejecting mechanism for ejecting the insertion card out.

The prior art discloses a stacked card connector comprises a main body and a socket mounted on a motherboard. The main body includes two stacked housings and a locator proximate the housings. A number of terminals in two sets are disposed in the two housings and extend from the housings in a distance, then extend downwardly to be arranged in two arrays in the locator. In assembly, the locator is inserted into the socket to electrically connect with the motherboard.

Since the terminals are so long and there is no device to fasten with, the terminals tend to be damaged or broken when extend into the locater. In assembly, it is hard to place the terminals directly into the locater. Furthermore, a transmission of information between the card connector and the socket may be interfered.

Therefore, the present invention is directed to solve above problem by providing a card connector which prevents the terminals being damaged or broken and makes the terminals connect with the socket exactly.

SUMMARY OF THE INVENTION

An object, therefore, of the invention is to provide a card connector receiving a plurality of terminals which are capable of connecting with a rear socket exactly and safely.

In the exemplary embodiment of the invention, a card connector includes an insulating housing comprising a base section and a fixing portion extending laterally from the base section, an ejecting mechanism mounted in the fixing portion, a plurality of first terminals received in the base section for electrically engaging with a first card, a terminal module located under the insulating housing and receiving a plurality of second terminals for electrically engaging with a second card, and a socket device comprising a spacer mounted on a rear end of the insulating housing, a daughter board in alignment with the spacer and a rear socket connecting with a plurality of connecting pins formed on the spacer. Wherein the first terminals and the second terminals pass through corresponding terminal holes defined on the spacer, thereafter engage with corresponding conductive portions formed on the daughter board.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
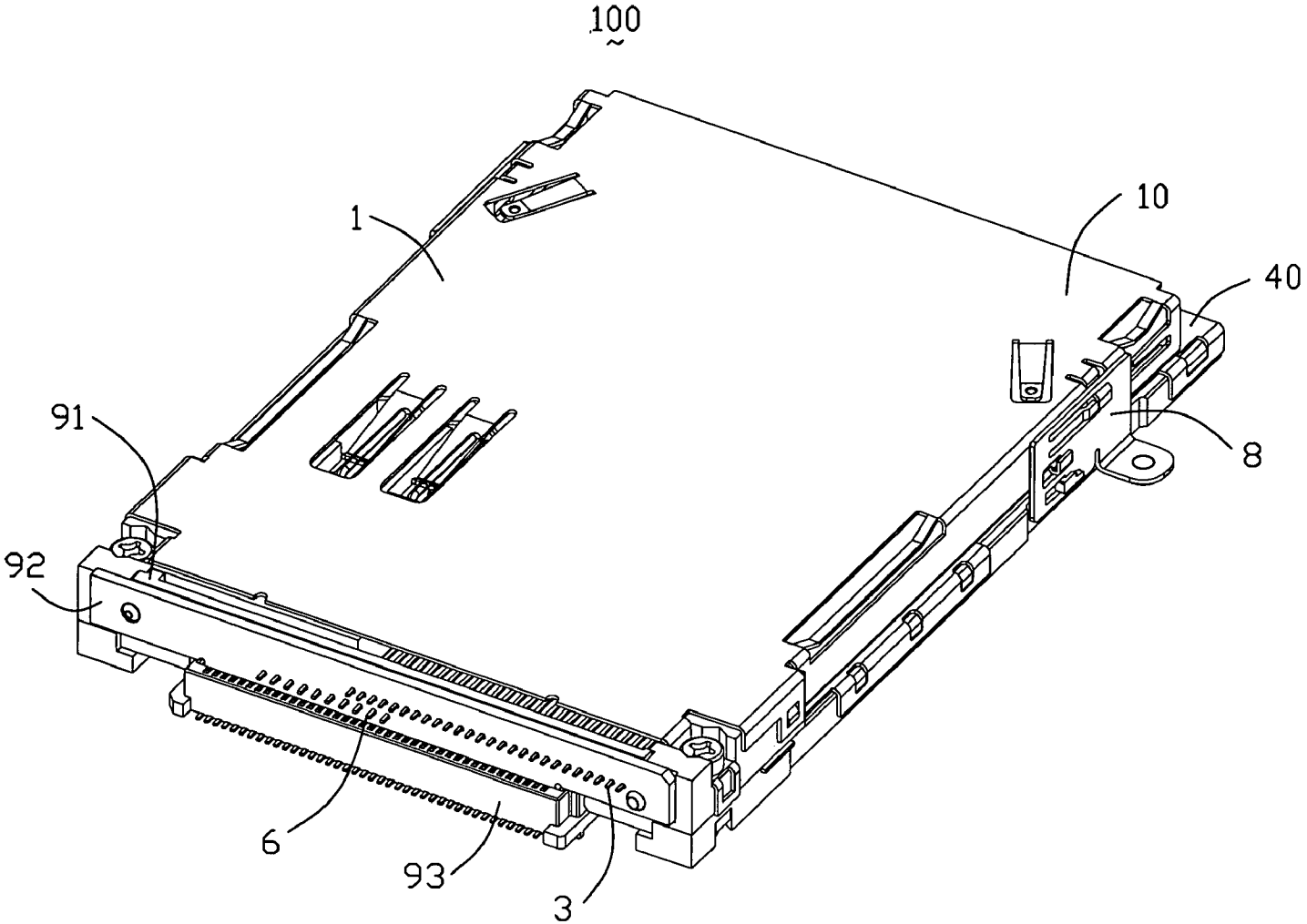
FIG. 1 is a perspective view of a card connector of present invention.

Referring to FIG. 1 to FIG. 5, the present invention provides a card connector 100 which is used for connection with two cards having mutually different transmission speeds, such as an Express card, and a Smart card. The card connector 100 comprises a first connector (not labeled), a second connector (not labeled) mounted under the first card connector as shown in FIG. 1, a socket device 9 and a pair of standing members 8 mounted on lateral sides of the card connector 100. The first connector and the second connector has, respectively, a first card slot (not labeled) for receiving the first card and a second card slot (not labeled) for receiving the second card. In the first card slot and the second card slot, a plurality of first terminals 3 and second terminals 6 are retained to electrically connect with corresponding cards.

Figure 2:
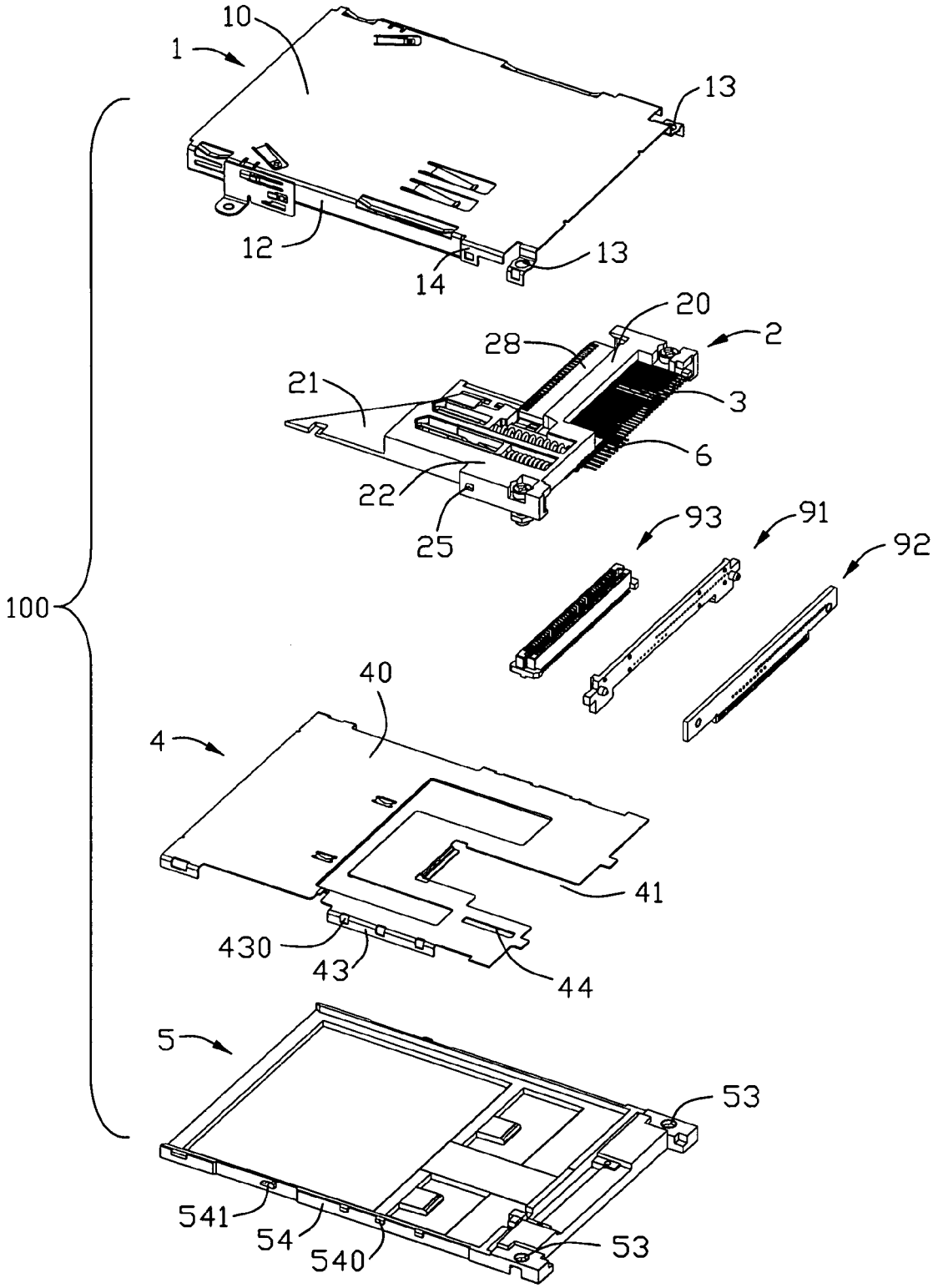
FIG. 2 is an exploded view of the card connector of present invention as shown in FIG. 1.

As shown in FIG. 1 and FIG. 2, the first connector comprises a first shell 1 constructed as a rectangular shape and an insulating housing 2 covered by the first shell 1. The first shell 1 associates with the first insulating housing 2 to define the first card slot. The first terminals 3 are received in the insulating housing 2 and protrude into the first card slot to engage with the first card. The first shell 1 comprises a main body 10, a pair of side walls 12 extending downwardly therefrom and a pair of limbs 14 proximate the side walls 12. Each limb 14 is designed with a locking hole 140. Adjacent to the limbs 14, a pair of screw portions 13 are formed with a screw holes 130 thereon. The first insulating housing 2 comprises a base section 20, an tongue portion 28 extending forwardly from the base section 20, a fixing portion 22 extending laterally from the base section 20 and a trapeziform guiding portion 21 extending forwardly from the fixing portion 22. In reason of the guiding portion 21, the first card slot defines a wider portion (not labeled) having an opening for a card being inserted and a narrower portion (not labeled) opposite to the wider portion. The base section 20 combining with the fixing portion 22 defines a width that is approximately equal to that of the first shell 1. At each end of the base section 20, an arm portion 24 is formed. Each arm portion 24 has a recess 240 dipping from an inner face thereof. At opposite lateral sides of the base section 20, a pair of fasten recesses 25 are formed for fastening with the locking hole 140 of the first shell 1.

Figure 5:
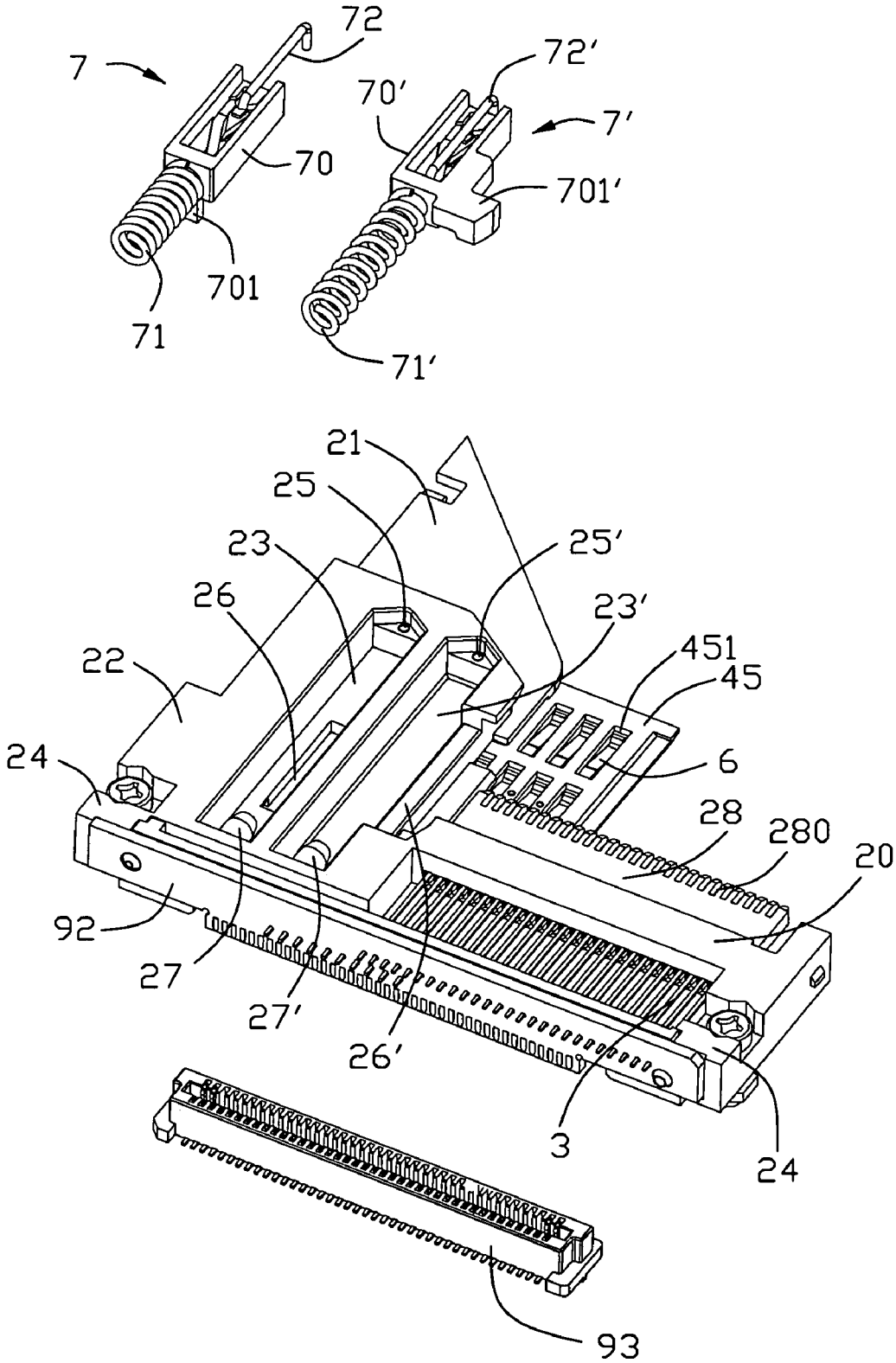
FIG. 5 is a perspective view of a pair of ejecting mechanisms and an insulating housing of the card connector as shown in FIG. 1.

As shown in FIG. 5, the fixing portion 22 comprises a first groove 23' adjacent to the first card slot and a second groove 23 arranged in a transverse line with the first groove 23' to receive a first ejecting mechanism 7' and a second ejecting mechanism 7 therein, respectively. Furthermore, the first groove 23' comprises a first slipping channel 26' communicating with the first card slot, a first position hole 25', and a first post 27' opposite to the position hole 25'. Accordingly, the second groove 23 comprises a second slipping channel 26 defined on a bottom surface thereof and communicating with the second card slot, a second position hole 25, and a second post 27 opposite to the second position hole 25.

Regarding to the second connector, it is placed under the first connector as shown in FIG. 1 and comprises a second shell 4, a terminal module 45 aligned with the second shell 4, and a bottom plate 5 associating with the second shell 4 to define the second card slot. The second terminals 6 are received in the terminal module 45 and protrude into the second card slot to engage with the second card. The second shell 4 comprises a main plate 40, and a pair of lateral portions 43 extending downwardly from the maim plate 40. The main plate 40 has a fixing hole 41 in alignment with the terminal module 45, and a longitudinal groove 44 in accordance with the second slipping groove 26 of the fixing portion 22. The longitudinal groove 44 is placed at a lateral side of the fixing hole 41. Each lateral portion 43 has a plurality of locking holes 430, correspondingly, the bottom plate 5 comprises a pair of side walls 54 having a plurality of recesses 540 to lock with the locking holes 430 of the second shell. Additionally, a locking recess 541 is formed on the side walls 54 and different from the recesses 540 to lock with the standing members 8.

As shown in FIG. 5, the first mechanism 7' and the second mechanism 7 are structured almost simple to each other and operated by an inserting card, and comprise, respectively, an ejecting member 70', 70 protruding into corresponding card slot, a spring member 71', 71 for moving the ejecting member 70', 70 towards the card ejecting direction, and a latch member 72', 72 capable of overcoming the spring member 71', 71 and placing the ejecting member 70', 70 in a desirable position. The first ejecting member 71' and the second ejecting member 71, respectively, have a pushing portion 701' extending laterally from one side of the ejecting member 71', 701 extending downwardly from a bottom face of the ejecting member 70. The latch portions 72', 72 move in an operating channel (not labeled) formed on the ejecting member 70', 70, respectively.

The relationship between the first ejecting mechanism 7', the second ejecting mechanism 7 and the first groove 23', the second groove 23 will be described in detail. The first ejecting mechanism 7' is mounted in the first groove 25' with the pushing portion 701' of the ejecting member 70' protruding into the first card slot, one end of the spring member 71' connecting the ejecting member 70' and the other aligned with the post 27', one end of the latch member 72' slipping in the operating groove of the ejecting member 70' and the other placed in the hole 25'. The second ejecting mechanism 7 is mounted in the second groove 25 in the same way as described of the first ejecting mechanism 7, except that the second pushing portion 701 protrudes downwardly into the second card slot by going through the second slipping channel 26 and the longitudinal groove 44 of the second shell 4 in order.

According with present invention, the first shell 1 define a pair of screw holes 13, the first insulating housing 2 define the same screw holes (not labeled), and the body plate 5 define a pair of screw hoes 53 at their end thereof, respectively, for a pair of screws (not labeled) passing through orderly. Then the first connector is positioned on the second connector and a rear portion of the card connector 100 is fastened. In addition, the standing members 8 are mounted on lateral sides thereof to fasten a front portion of the card connector 100 and located on a printed circuit board (not shown). The first ejecting mechanism 7' and the second mechanism 7 are placed correspondingly in the first groove 23' and the second groove 23 of the fixing portion 22 with the pressing pieces 11 pressing on the first latch member 72' and the second latch member 72.

Figure 3:
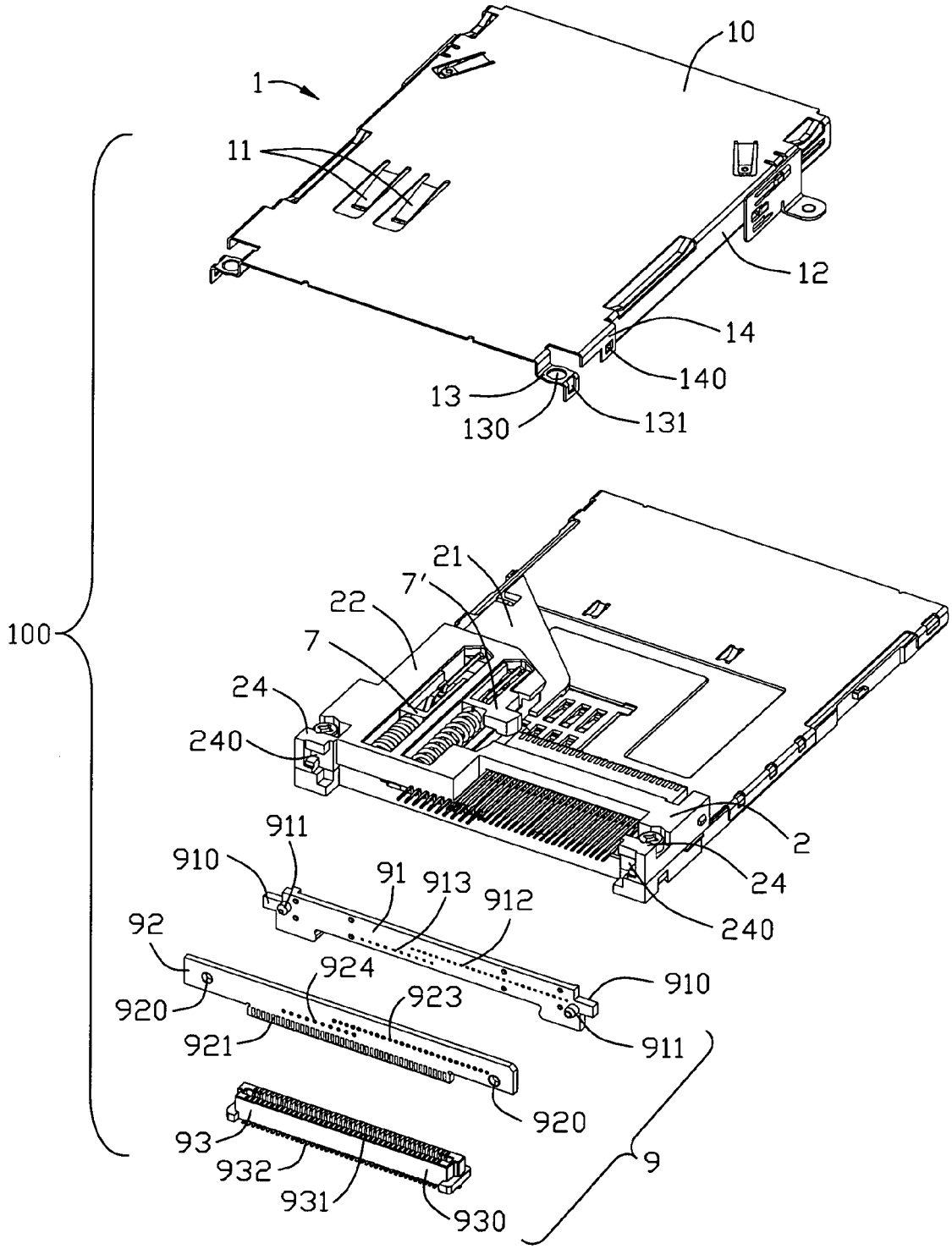
FIG. 3 is a partial exploded view of the card connector of present invention.
Figure 4:
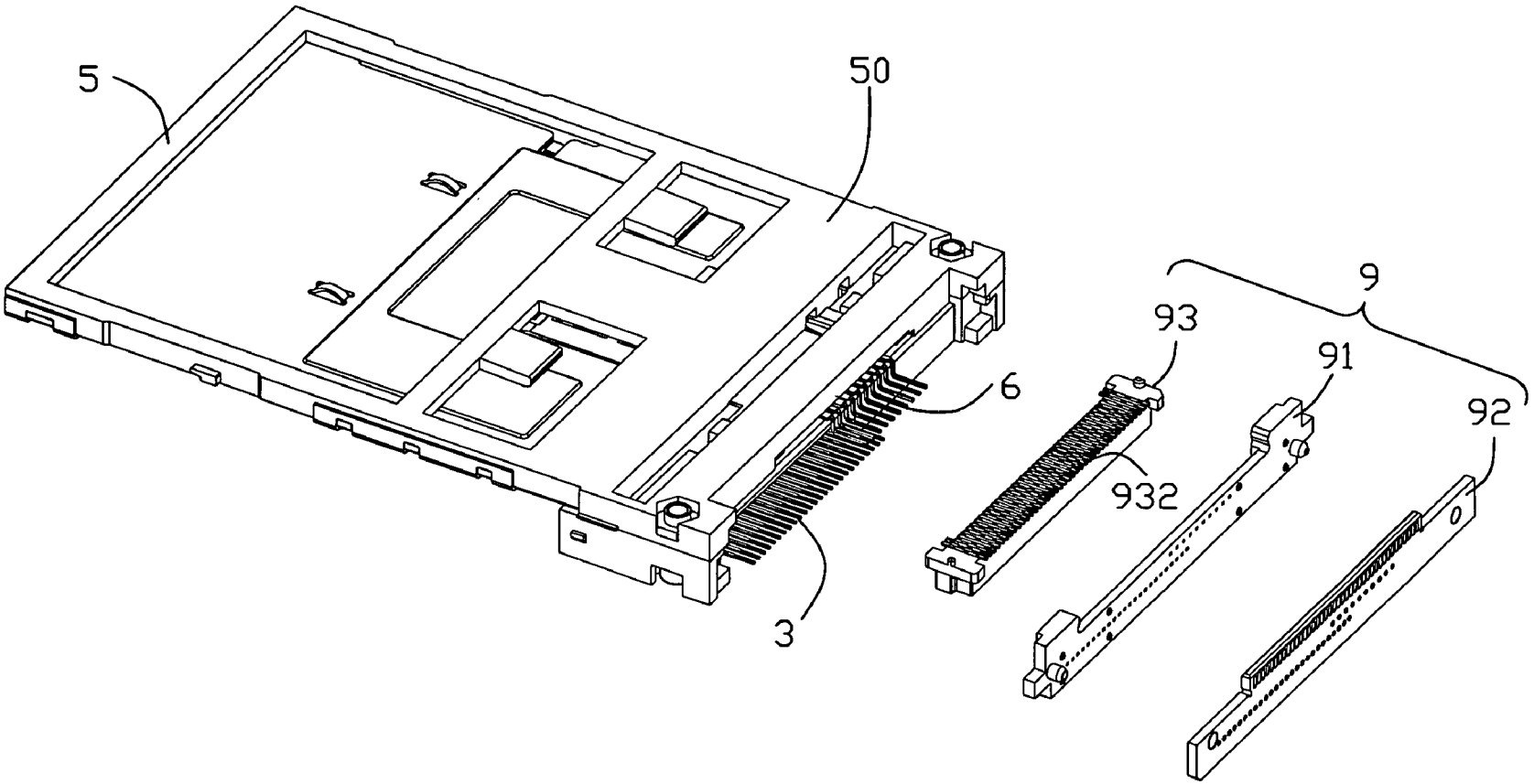
FIG. 4 is a perspective view of a socket device replaced from the card connector of present invention.

Referring to FIG. 3, the socket device 9 comprises a spacer 91, a daughter board 92 and a rear socket 93. The spacer 91 is of a longitudinal shape and comprises a plurality of first terminal holes 912, a plurality of second terminal holes 913 arranged under the first terminal holes 912, a pair of posts 911 protruding in an insertion direction of the card near the lateral side of the terminal holes, and a pair of holding sections 910 extending laterally from the opposite ends of the spacer 91.

According with the shape of the spacer 91, the daughter board 92 comprises a plurality of first conductive portions 923 in according with the first terminal holes 912 for a connection with the first terminals 3, a plurality of second conductive portions 924 in according with the second terminal holes 913 for a connection with the second terminals 6, a pair of position holes 920 for the posts 911 of the spacer 91 passing through, and a plurality of connecting pins 921 fixed on the opposite faces thereof and under the conductive portions.

The rear socket 93 is used as a medium between the daughter board 92 and a printed circuit board for an information transmission of the cards, and comprises a main portion 930, and a receiving groove 931 surrounded by the main portion 930. The receiving groove 931 comprises a plurality of engaging parts (not labeled) therein and a plurality of soldering parts 932 extending out of the receiving groove 931 to contact with the printed circuit board electrically.

In assembly, the first shell 1 is mounted on the insulating housing 2 to define the first card slot and the second shell 4 associating with the terminal module 45 to be mounted on the body plate 5 to define the second card slot. After such assembly, the socket device 9 is fixed at a rear end of the card connector 100 by the holding sections 910 of the spacer 91 retained in corresponding fixing portion 240 of the insulating housing 2. The daughter board 92 mates with the spacer 91 by the posts 911 of the spacer 91 passing through the position hole 920 of the daughter board 92. The daughter board 92 is inserted into the rear socket 93 by the connecting pins 921 electrically connecting with the engaging part of the rear socket 93. The first terminals 3 and the second terminals 6 firstly pass through the first through holes 912 and the second through holes 913, respectively, thereafter to electrically engage with the first conductive portions 923 and the second conductive portions 924, preventing being damaged or tended during assembly and capable of connecting with corresponding conductive portions exactly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A card connector for connecting with two cards, comprising:

an insulating housing comprising a base section and a fixing portion beside the base section;

a plurality of first terminals received in the base section for electrically engaging with a first card;

a terminal module located under the insulating housing and receiving a plurality of second terminals for electrically engaging with a second card; and a socket device comprising a spacer mounted on a rear end of the insulating housing, a daughter board in alignment with the spacer and having a plurality of connecting pins, and a rear socket connecting with the connecting pins;

wherein the first terminals and the second terminals pass through corresponding terminal holes defined on the spacer, and engage with corresponding conductive portions formed on the daughter board; wherein there are two ejecting mechanisms for ejecting the first card and the second card, respectively, and the fixing portion comprises two grooves to receive the corresponding ejecting mechanisms therein.

2. The card connector as claimed in claim 1, wherein the first terminals and the second terminals are arranged in different levels.

3. The card connector as claimed in claim 1, wherein the first terminals and the second terminals are arranged in different rows, respectively.

4. The card connector as claimed in claim 1, wherein the second terminals are arranged in two rows to mate with an inserted second card.

5. The card connector as claimed in claim 1, wherein the insulating housing comprises a pair of arm portions extending from opposite ends of the base section, and the spacer is placed between the arm portions.

6. The card connector as claimed in claim 5, wherein each arm portion has a fixing portion recessed from an inner face thereof, and a holding portion is formed on each lateral side of the spacer to fasten with the fixing portion.

7. The card connector as claimed in claim 1, wherein the spacer comprises a pair of posts extending in an insertion direction of the card, and a pair of position holes are defined on the daughter board to fasten with the posts of the spacer.

8. The card connector as claimed in claim 1, wherein the grooves are arranged in a transverse direction perpendicular to the insertion direction of the card.

9. The card connector as claimed in claim 1, wherein the first ejecting mechanism and the second mechanism extend in different directions to engage with the first card and the second card, respectively.

10. The card connector as claimed in claim 1, wherein the first ejecting mechanism extend in a direction perpendicular to that of the second ejecting mechanism to engage with the first card.

11. The card connector as claimed in claim 1, wherein a trapeziform guiding portion is formed forwardly of the fixing portion extending forwardly.

12. A card connector for connecting with two cards, comprising:

an insulating housing comprising a base section and a fixing portion beside the base section;

an ejecting mechanism mounted in the fixing portion;

a plurality of first terminals received in the base section for electrically engaging with a first card;

a terminal module located under the insulating housing and receiving a plurality of second terminals for electrically engaging with a second card; and a socket device comprising a spacer mounted on a rear end of the insulating housing, a daughter board in alignment with the spacer and having a plurality of connecting pins, and a rear socket connecting with the connecting pins;

wherein the first terminals and the second terminals pass through corresponding terminal holes defined on the spacer, and engage with corresponding conductive portions formed on the daughter board; wherein the ejecting mechanism is operated by an inserted card and comprises an ejecting member to engage with an inserted card directly, a latch member to move in a desired pattern, and a spring member capable of overcoming the latch member and pushing the ejecting member toward an original position.

13. A card connector assembly comprising:

a connector unit including upper and lower contacts respectively extending into upper and lower mating ports thereof, each of said upper and lower mating ports being of a card-like receiving space, each of said upper and lower contacts defining a horizontal tail;

a spacer located on a rear side of the connector unit and defining upper and lower through holes through which said tails of the corresponding upper and lower contacts extend;

a daughter board attached to the spacer and defining a plurality of upper and lower through apertures in alignment with the corresponding through holes, respectively, through which said tails of the corresponding upper and lower contacts extend;

an interface connector located below the daughter board and receiving a lower edge of the daughter board; and two ejecting mechanisms having means extending into the corresponding mating ports for ejecting a first card and a second card respectively;

wherein the connector unit defines two grooves to receive the two ejecting mechanisms, respectively.

14. The card connector assembly as claimed in claim 13, wherein the connector unit is fastened to a mother board on which said connector unit is seated, and said interface connector is soldered upon the mother board.

15. The card connector assembly as claimed in claim 13, wherein one ejecting mechanism of said two ejecting mechanism comprises a first pushing portion laterally protruding into the upper mating port for mating with the first card and the other ejecting mechanism of said two ejecting mechanism comprises a second pushing portion downwardly protruding into the lower mating port for mating with the second card.

16. The card connector assembly as claimed in claim 13, wherein said two ejecting mechanisms are closely side by side located with each other.

* * * * *